US008206173B2

(12) United States Patent
Won

(10) Patent No.: US 8,206,173 B2
(45) Date of Patent: Jun. 26, 2012

(54) CONNECTOR ASSEMBLY, DISPLAY APPARATUS HAVING THE SAME AND METHOD OF CONNECTING THE SAME

(75) Inventor: Joo-Yeon Won, Seoul (KR)

(73) Assignee: Samsung Electronics Co., Ltd. (KR)

( * ) Notice: Subject to any disclaimer, the term of this patent is extended or adjusted under 35 U.S.C. 154(b) by 0 days.

(21) Appl. No.: 12/952,753

(22) Filed: Nov. 23, 2010

(65) Prior Publication Data

US 2011/0063342 A1 Mar. 17, 2011

Related U.S. Application Data

(63) Continuation of application No. 12/421,174, filed on Apr. 9, 2009, now Pat. No. 7,867,012.

(30) Foreign Application Priority Data

May 9, 2008 (KR) ..... 10-2008-0043530

(51) Int. Cl.
*H01R 13/62* (2006.01)

(52) U.S. Cl. ..... 439/372

(58) Field of Classification Search ..... 439/369, 439/370, 372, 373
See application file for complete search history.

(56) References Cited

U.S. PATENT DOCUMENTS

| | | | | |
|---|---|---|---|---|
| 2,389,895 | A | 11/1945 | Colley et al. | |
| 7,056,142 | B2 | 6/2006 | Ueda | |
| 7,867,012 | B2 * | 1/2011 | Won | 439/372 |

FOREIGN PATENT DOCUMENTS

| | | |
|---|---|---|
| JP | 2000150029 | 5/2000 |
| JP | 2004335360 | 11/2004 |
| KR | 1020060078869 | 7/2006 |

* cited by examiner

*Primary Examiner* — Phuong Dinh
(74) *Attorney, Agent, or Firm* — Cantor Colburn LLP

(57) ABSTRACT

A connector assembly includes a first connector having a recess disposed in a first side thereof, a second connector disposed in the recess and connected to the first connector, and a lever rotatably connected to the second connector. The lever is rotated toward the first connector by an external force after the second connector is connected to the first connector. The lever is connected to the first connector to fix the second connector in the recess of the first connector.

20 Claims, 4 Drawing Sheets

CONNECTOR ASSEMBLY, DISPLAY APPARATUS HAVING THE SAME AND METHOD OF CONNECTING THE SAME

This application is a continuation of U.S. application Ser. No. 12/421,174, filed on Apr. 9, 2009, which claims priority to Korean Patent Application No. 2008-43530, filed on May 9, 2008, and all the benefits accruing therefrom under 35 U.S.C. §119, the contents of which in its entirety are herein incorporated by reference.

BACKGROUND OF THE INVENTION

1. Field of the Invention

The present invention relates to a connector assembly and a display apparatus having the same. More particularly, the present invention relates to a connector assembly having a thin structure providing improved production efficiency and image display quality, and a display apparatus having the connector assembly.

2. Description of the Related Art

A liquid crystal display ("LCD") has a thin structure, light weight and operates at lower power consumption than other types of displays, such as a cathode ray tube ("CRT"), for example. As a result, the LCD is used extensively in various industrial fields. The LCD typically includes a liquid crystal display panel to display images thereon, a backlight unit which provides light to the liquid crystal display panel and a driving circuit which provides driving signals to the liquid crystal display panel.

The driving circuit generally includes a gate driver to drive gate lines of the liquid crystal display panel, a data driver to drive data lines of the liquid crystal display panel and a printed circuit board which supplies control signals and/or power to the gate driver and the data driver. A connector, which receives external power and control signals, is mounted on the printed circuit board. More specifically, the connector is typically connected to a signal transmission film on the printed circuit board to electrically connect the printed circuit board to the signal transmission film in order to provide the external power and control signals to the driving circuit.

As a thickness of the LCD is reduced, however, a thickness of the connector must also be reduced. As a result, a connector having the reduced thickness is easily damaged when the LCD is manufactured, and a productivity of manufacturing the LCD is thereby reduced. In addition, a connection fault often occurs, due to the reduced thickness of the connector, and a display quality of the image displayed on the LCD therefore deteriorates.

BRIEF SUMMARY OF THE INVENTION

An exemplary embodiment of the present invention provides a connector assembly having a thin structure which is easily manufactured without being damaged.

An alternative exemplary embodiment of the present invention provides a display apparatus including the connector assembly having the thin structure.

In an exemplary embodiment of the present invention, a connector assembly includes a first connector, a second connector and a lever. The first connector has a recess disposed in a first side thereof. The second connector is disposed in the recess and is connected to the first connector. The lever is rotatably connected to the second connector. The lever is rotated toward the first connector by an external force after the second connector is connected to the first connector, and is connected to the first connector to fix the second connector in the recess of the first connector.

The first connector may include a lever fixing member which receives the lever to fix the lever to the first connector.

The lever fixing member may include a protrusion which protrudes outward from the lever fixing member from at least one of a second side opposite to the first side having the recess disposed therein and a third side adjacent to the first side having the recess.

The lever may include a first rotating member rotatably connected to a first side of the second connector, a second rotating member rotatably connected to a second side of the second connector, the second side of the second connector disposed opposite to the first side of the second connector, and a connection bar connecting the first rotating member to the second rotating member.

The lever fixing member may be disposed on the second surface opposite to the first surface having the recess, and the connection bar may be fixed to the lever fixing member.

The first connector may include a first terminal and the second connector may include a second terminal.

The connector assembly may further include an auxiliary handle connected to the lever, and the auxiliary handle may include an insulating material.

In an alternative exemplary embodiment of the present invention, a display apparatus includes a display panel, a backlight assembly, a gate driver, a data driver, a timing controller, a driving circuit board, a first connector, a second connector, a signal transmission member and a lever.

The display panel includes a gate line and a data line disposed thereon. The backlight assembly supplies light to the display panel. The gate driver drives the gate line and the data driver drives the data line. The timing controller supplies a control signal to the gate driver and the data driver. The timing controller is disposed on the driving circuit board. The first connector is disposed on the driving circuit board. The first connector is electrically connected to the driving circuit board and a recess is disposed in a first side thereof. The second connector is disposed in the recess and is connected to the first connector. The signal transmission member is connected to the second connector to supply an external power signal and/or an external driving signal to the driving circuit board. The lever is rotatably connected to the second connector. The lever is rotated toward the first connector by an external force after the second connector is connected to the first connector, and is connected to the first connector to fix the second connector in the recess of the first connector.

The first connector may include a lever fixing member which receives the lever to fix the lever to the first connector.

The lever fixing member may include a protrusion which protrudes from the lever fixing member from at least one of a second side opposite to the first side having the recess disposed therein and a third side adjacent to the first side having the recess.

The lever may include: a first rotating member rotatably connected to first side of the second connector; a second rotating member rotatably connected to a second side of the second connector, the second side of the second connector disposed opposite to the first side of the second connector; and a connection bar connecting the first rotating member to the second rotating member.

The protrusion may be disposed on the third side opposite to the first side having the recess, and the connection bar may be fixed to the protrusion.

The first connector may include a first terminal, and the second connector may include a second terminal.

In yet another alternative exemplary embodiment of the present invention a method of connecting a connector assembly, the connector assembly including a first connector having a recess disposed therein, includes: disposing a second connector in the recess, the second connector including a lever attached thereto; applying an external force to the lever; and rotating the lever toward the first connector to fix the second connector in the recess of the first connector.

The method may further include receiving the lever in a lever fixing member of the first connector.

Thus, according to exemplary embodiments of the present invention, a lever is connected to a second connector and a first connector is connected to the second connector through the lever. Thus, the lever connected to the first connector fixes the first connector to the second connector. As a result, the first connector is easily connected to the second connector, effectively preventing the second connector from being separated from the first connector. Therefore, a driving circuit board is easily connected to a signal transmission member, thereby substantially decreasing an assembling time of a display apparatus while also preventing connection faults from forming while assembling the display apparatus, thereby effectively improving a display quality of an image displayed thereon.

BRIEF DESCRIPTION OF THE DRAWINGS

The above and other aspects, features and advantages of the present invention will become more readily apparent by describing in further detail exemplary embodiments thereof with reference to the accompanying drawings, in which.

DETAILED DESCRIPTION OF THE INVENTION

Figure 1:
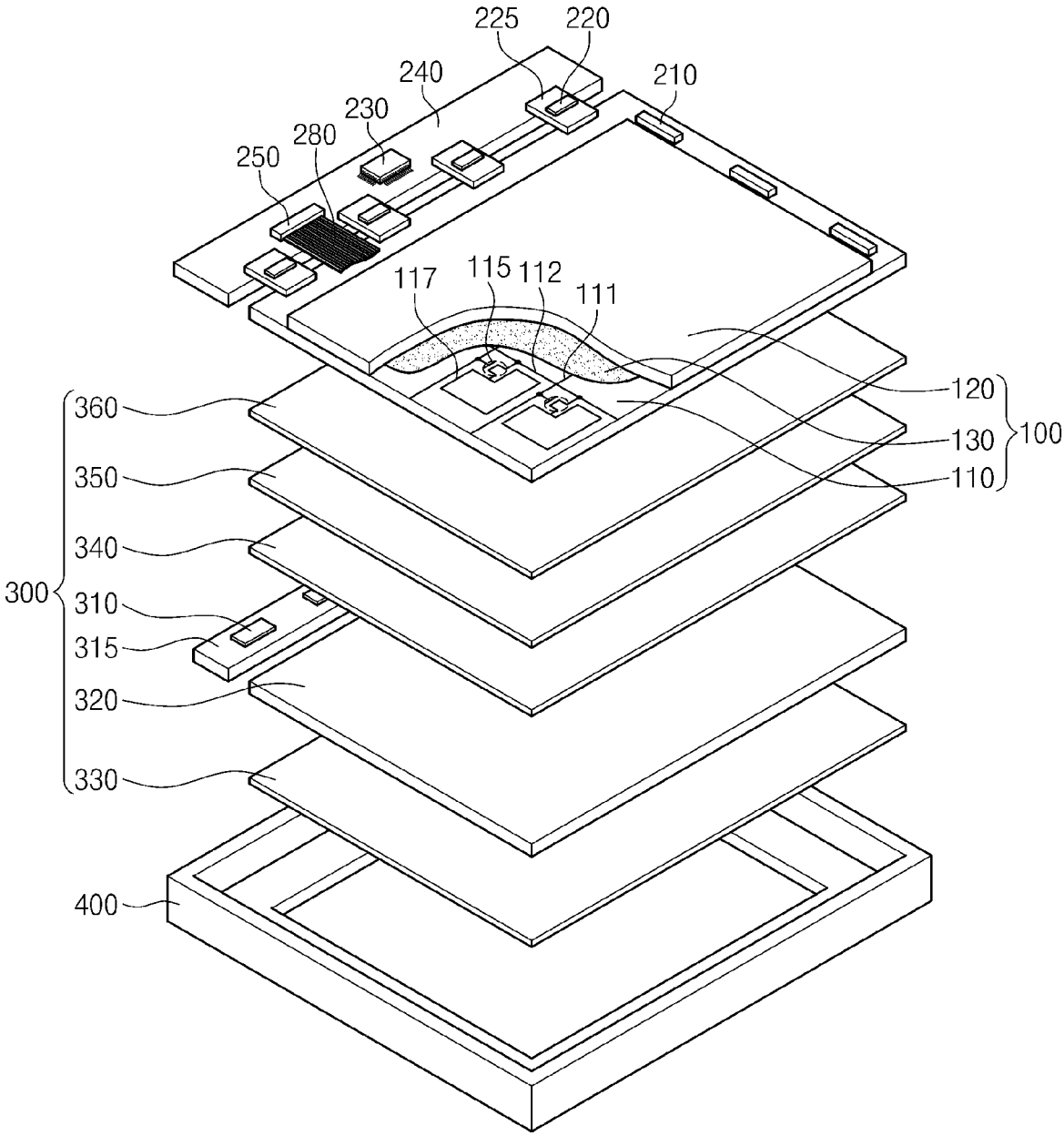
FIG. 1 is an exploded perspective view of a display apparatus according to an exemplary embodiment of the present invention.

The invention will now be described more fully hereinafter with reference to the accompanying drawings, in which exemplary embodiments of the invention are shown. The present invention may, however, be embodied in many different forms and should not be construed as limited to the embodiments set forth herein. Rather, these embodiments are provided so that this disclosure will be thorough and complete, and will fully convey the scope of the invention to those skilled in the art. Like reference numerals refer to like elements throughout.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

It will be understood that although the terms "first," "second," "third" etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed below could be termed a second element, component, region, layer or section without departing from the teachings of the present invention.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," or "includes" and/or "including," when used in this specification, specify the presence of stated features, regions, integers, steps, operations, elements and/or components, but do not preclude the presence or addition of one or more other features, regions, integers, steps, operations, elements, components and/or groups thereof.

Furthermore, relative terms, such as "lower" or "bottom" and "upper" or "top" may be used herein to describe one element's relationship to other elements as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on the "upper" side of the other elements. The exemplary term "lower" can, therefore, encompass both an orientation of "lower" and "upper," depending upon the particular orientation of the figure. Similarly, if the device in one of the figures were turned over, elements described as "below" or "beneath" other elements would then be oriented "above" the other elements. The exemplary terms "below" or "beneath" can, therefore, encompass both an orientation of above and below.

Unless otherwise defined, all terms (including technical and scientific terms) used herein have the same meaning as commonly understood by one of ordinary skill in the art to which the present invention belongs. It will be further understood that terms, such as those defined in commonly used dictionaries, should be interpreted as having a meaning which is consistent with their meaning in the context of the relevant art and the present disclosure, and will not be interpreted in an idealized or overly formal sense unless expressly so defined herein.

Exemplary embodiments of the present invention are described herein with reference to cross section illustrations which are schematic illustrations of idealized embodiments of the present invention. As such, variations from the shapes of the illustrations as a result, for example, of manufacturing techniques and/or tolerances, are to be expected. Thus, embodiments of the present invention should not be construed as limited to the particular shapes of regions illustrated herein but are to include deviations in shapes which result, for example, from manufacturing. For example, a region illustrated or described as flat may, typically, have rough and/or nonlinear features. Moreover, sharp angles which are illustrated may be rounded. Thus, the regions illustrated in the figures are schematic in nature and their shapes are not intended to illustrate the precise shape of a region and are not intended to limit the scope of the present invention.

Hereinafter, exemplary embodiments of the present invention will be described in further detail with reference to the accompanying drawings.

FIG. 1 is an exploded perspective view of a display apparatus according to an exemplary embodiment of the present invention.

Referring to FIG. 1, a display apparatus according to an exemplary embodiment includes a display panel 100, gate drivers 210, data drivers 220, a timing controller 230, a driving circuit board 240, a connector assembly 250, a backlight assembly 300 and a mold frame 400.

The display panel 100 includes a thin film transistor substrate 110, a color filter substrate 120, and liquid crystals 130 interposed between the thin film transistor 110 and the color filter substrate 120.

The thin film transistor substrate 110 includes gate lines 111 extending in a first direction, data lines 112 crossing the gate lines 111 and extending in a second direction substantially perpendicular to the first direction, thin film transistors 115 connected to the gate lines 111 and the data lines 112, and pixel electrodes 117 connected to the thin film transistors 115.

The color filter substrate 120 includes a common electrode (not shown) which forms an electric field with the pixel electrodes 117, and color filters (not shown) to enable color display.

The liquid crystals 130 have dielectric anisotropy and are aligned between the thin film transistor substrate 110 and the color filter substrate 120. In operation, an alignment of the liquid crystals 130 is adjusted, based on the electric field between the common electrode and the pixel electrodes 117, to control a transmittance of light supplied from the backlight assembly 300 therethrough.

In an exemplary embodiment, the gate drivers 210 are disposed at a first end of the thin film transistor substrate 110 using a chip-on-glass ("COG") method, for example. The gate drivers 210 supply a gate on signal and a gate off signal to the gate lines 111. In an exemplary embodiment, the gate drivers 210 may be disposed on the thin film transistor substrate 110.

The data drivers 220 are mounted on signal transmission films 225 by a tape carrier package ("TCP") method, for example. The data drivers 220 are electrically connected to the thin film transistor substrate 110 and the driving circuit board 240 through the signal transmission films 225. The data drivers 220 supply data signals to the data lines 112.

The timing controller 230 is mounted on the driving circuit board 240. The timing controller 230 supplies control signals to the gate drivers 210 and the data drivers 220. In addition, the timing controller 230 supplies pixel data, e.g., image data, to the data drivers 220 to display a desired image on the display apparatus according to an exemplary embodiment of the present invention.

The driving circuit board 240 includes a printed circuit board ("PCB") with a plurality of signal transmission lines disposed thereon. The timing controller 230, the connector assembly 250 and other elements (not shown) are mounted on the driving circuit board 240. The driving circuit board 240 receives an external power and/or other signals through the connector assembly 250 to supply the external power and/or the other signals to the timing controller 230. In addition, the driving circuit board 240 supplies power to the gate drivers 210 and the data drivers 220 through the signal transmission films 225.

As shown in FIG. 1, the connector assembly 250 is disposed on, e.g., is mounted on, the driving circuit board 240. Further, the connector assembly 250 is connected to a signal transmission member 280. The connector assembly 250 receives power and/or driving signals from the signal transmission member 280 to thereafter transmit the power and/or driving signals to the driving circuit board 240. The connector assembly 250 will be described in further detail below with reference to FIGS. 2, 3, 4A and 4B.

Still referring to FIG. 1, the backlight assembly 300 is disposed substantially below the display panel 100 to supply light to the display panel 100. To supply the light, the backlight assembly 300 includes a light source 310, a light source substrate 315, a light guide plate 320, a reflective sheet 330, a diffusion sheet 340, a prism sheet 350 and a protective sheet 360.

The light source 310 generates light to be supplied to the display panel 100. In an exemplary embodiment of the present invention, the light source 310 may include a plurality of light emitting diodes ("LEDs"), for example, or, alternatively, a lamp. In an exemplary embodiment, LEDs are used as the light source 310 to reduce a thickness of the display apparatus. The light sources 310 are mounted on the light source substrate 315, as shown in FIG. 1. In addition, the light sources 310 are positioned at a peripheral side of the light guide plate 320 to emit light toward the light guide plate 320.

The light source substrate 315 according to an exemplary embodiment includes a printed circuit board ("PCB") or, alternatively, a flexible printed circuit board ("FPCB"), but alternative exemplary embodiments are not limited thereto. The light source substrate 315 supplies power to the light source 310. Specifically, the light source substrate 315 is electrically connected to a power source, such as an inverter, for example, to supply power to the light source 310. The light source substrate 315 is disposed in the mold frame 400.

The light guide plate 320 directs the light upward, e.g., toward the display panel 100. In an exemplary embodiment of the present invention, the light guide plate 320 includes an acrylic material. In addition, the light guide plate 320 may include a dot pattern or a V-shaped pattern to reflect, e.g., to direct, the light.

The reflective sheet 330 is disposed below the light guide plate 320, as shown in FIG. 1. The reflective sheet 330 reflects light emitted downward from the light guide plate 320 toward the display panel 100.

The diffusion sheet 340 is disposed on the light guide plate 320. The diffusion sheet 340 diffuses the light exiting the light guide plate 320, and the light is thereby uniformly supplied to the display panel 100.

The prism sheet 350 is disposed on the diffusion sheet 340. The prism sheet 350 aligns the light which has passed through the diffusion sheet 340 to be vertically incident onto the display panel 100.

The protective sheet 360 protects the prism sheet 350 from damage such as scratches from external impact, for example.

In an exemplary embodiment, the mold frame 400 includes an electrically insulating material, such as plastic, for example. The mold frame 400 receives the display panel 100, the driving circuit board 240 and the backlight assembly 300 to protect them from damage from external impact, for example.

Hereinafter, the connector assembly 250 according to an exemplary embodiment of the present invention will be described in further detail with reference to FIGS. 2, 3, 4A and 4B.

Figure 2:
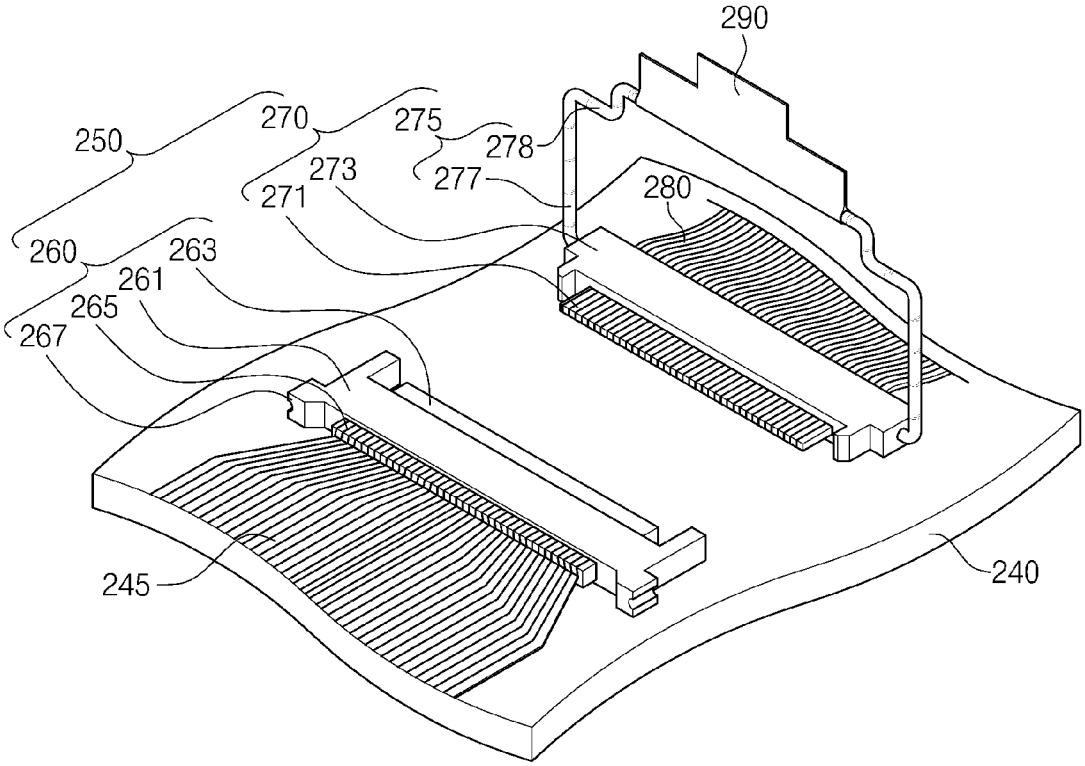
FIG. 2 is a top perspective view illustrating a disassembled connector assembly of the display apparatus according to the exemplary embodiment of the present invention shown in FIG. 1.
Figure 3:
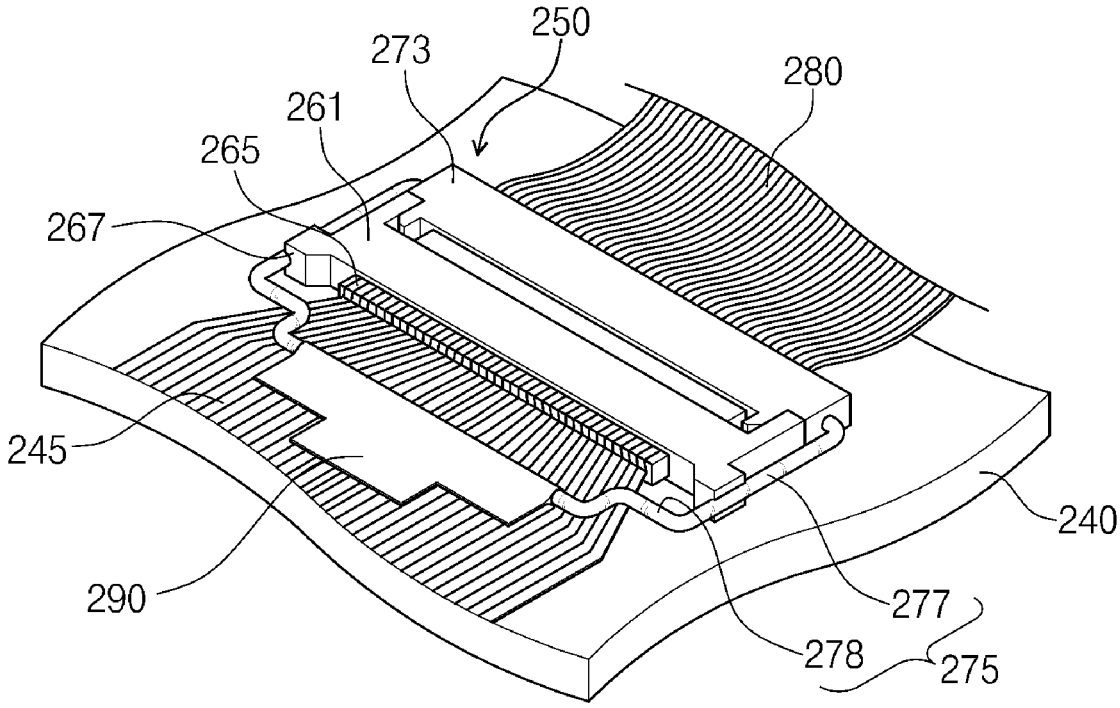
FIG. 3 is a top perspective view illustrating an assembled connector assembly of the display apparatus according to the exemplary embodiment of the present invention shown in FIG. 1.
Figure 4A:
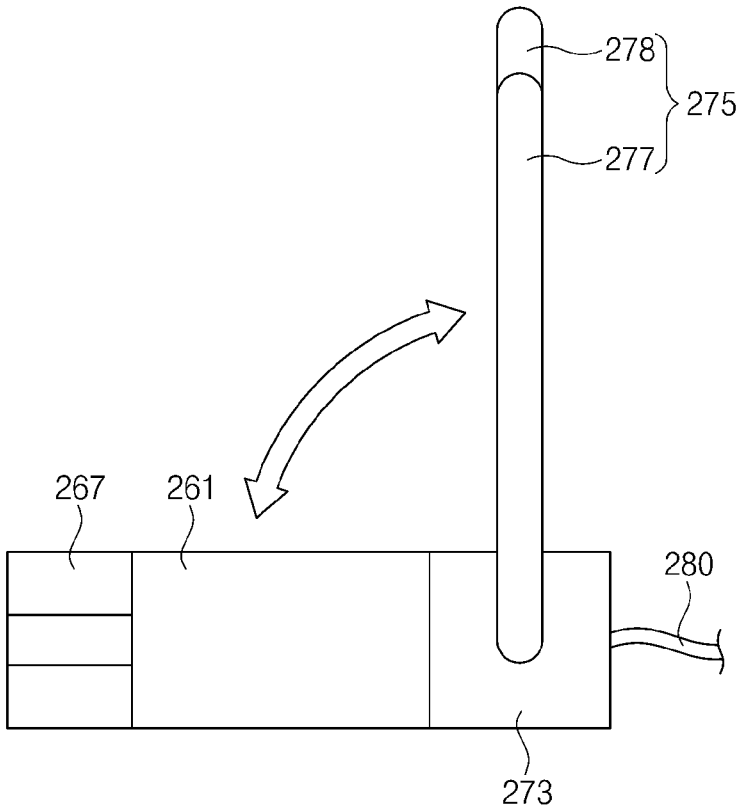
FIGS. 4A and 4B are side perspective views of the connector assembly of the display apparatus according to the exemplary embodiment of the present invention shown in FIG. 3.
Figure 4B:
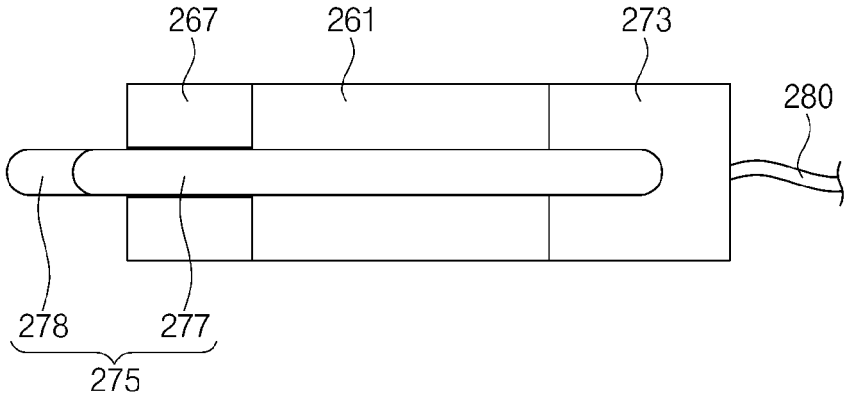

FIG. 2 is a top perspective view illustrating a disassembled connector assembly 250 of the display apparatus according to the exemplary embodiment of the present invention shown in FIG. 1, FIG. 3 is a top perspective view illustrating an assembled connector assembly 250 of the display apparatus according to the exemplary embodiment of the present invention shown in FIG. 1, and FIGS. 4A and 4B are side perspective views of the connector assembly 250 according to the exemplary embodiment of the present invention shown in FIG. 3.

Referring to FIGS. 2, 3, 4A and 4B, the connector assembly 250 includes a first connector 260 mounted on, e.g., disposed on, the driving circuit board 240, a second connector 270 connected to the first connector 260 (FIGS. 3 and 4B), and a lever 275 connected to the second connector 270.

The first connector 260 according to an exemplary embodiment includes a first housing 261, a recess 263, a first terminal 265 and a lever fixing member 267.

The first housing 261 is coupled with, e.g., is connected to, the driving circuit board 240. In an exemplary embodiment of the present invention, the first housing 261 is an insulating member having a substantially rectangular shape. In an exemplary embodiment, for example, the first housing 261 is made from plastic and is bonded to the driving circuit board 240 with an adhesive, but alternative exemplary embodiments of the present invention are not limited thereto.

The recess 263 is disposed in a first side of the first housing 261, as shown in FIG. 2. More specifically, a position of the recess 263 in the first housing 261 corresponds to a position of the second connector 270 when the second connector 270 is connected to the first connector 260, (best shown in FIG. 3).

The first terminal 265 according to an exemplary embodiment includes a plurality of leads disposed at a second side of the first housing 261 opposite the recess 263, e.g., opposite to the first side thereof. At least a portion of the first terminal 265 is disposed in the first housing 261. Thus, the first terminal 265 is at least partially exposed through the recess 263 at the first side of the first housing 261. In addition, the first terminal 265 is electrically connected to a plurality of signal transmission lines 245 disposed on the driving circuit board 240.

In an exemplary embodiment, the lever fixing member 267 is disposed on a third side of the first housing 261, e.g., adjacent to the recess 263 on the first side of the first housing 261, but alternative exemplary embodiments of the present invention are not limited thereto. For example, the lever fixing member 267 may be disposed on the second side, e.g., opposite to the recess 263. The lever fixing member 267 protrudes from the first housing 261 to fix the lever 275 thereto, as best shown in FIG. 3.

In an exemplary embodiment, the second connector 270 includes a second terminal 271 and a second housing 273. In addition, the second connector 270 is connected to the signal transmission member 280 which transmits the external power and/or the external driving signals.

In an exemplary embodiment, the second terminal 271 includes a plurality of conductive pins. The second terminal 271 is fitted into the recess 263 and is thereby electrically connected to the first terminal 265. In an exemplary embodiment of the present invention, the second terminal 271 may include an insulating substrate having a plurality of signal lines disposed thereon, for example.

The second housing 273 is coupled with, e.g., is connected to, the second terminal 271. In addition, the second housing 273 covers at least a portion of the second terminal 271. Thus, the second housing 273 includes an insulating member which covers a portion of the second terminal 271. In an exemplary embodiment, the second housing 273 is integrally formed with, e.g., is a part of, the second terminal 271.

The lever 275 is connected to, e.g., is coupled to, a first side and an opposite second side of the second housing 273, as shown in FIG. 2. Specifically, the lever 275 includes first and second rotating members 277, each rotatably connected to the second housing 273, and a connection bar 278 connecting the first and second rotating members 277 to each other, as shown in FIGS. 2 and 3.

The first and second rotating members 277 are inserted into holes, e.g., apertures, disposed at the first and second sides, respectively, of the second housing 273 adjacent to the first terminal 265. Further, first end portions of each of the first and second rotating members 277, are bent to be inserted into the holes in the second housing 273. Thus, the first and second rotating members 277 rotate about an axis defined by the end portions thereof inserted into the holes. The connection bar 278 connects opposite second ends of the first and second rotating members 277, which are coupled to both sides of the second housing 273, to each other. Thus, the connection bar 278 is connected between the second end portions of the first and second rotating members 277 to serve as a handle, for example.

In an exemplary embodiment, the lever 275 may be formed by connecting the rotating members 277 to the connection bar 278. In addition, the lever 275 may be formed by bending a rod, for example, such that the rod is divided to integrally form the first and second rotating members 278 and the connection bar 278.

In an exemplary embodiment of the present invention, the lever 275 includes an insulating material or, alternatively, a conductive material. When the lever 275 is made from the conductive material, an auxiliary handle 290 is connected to the lever 275 to electrically insulate the lever 275, as shown in FIG. 3.

The auxiliary handle 290 is connected to the connection bar 278. Further, the auxiliary handle 290 is made from an insulating material. For example, the auxiliary handle 290 according to an exemplary embodiment is made from an insulating film which is connected to the connection bar 278. In an exemplary embodiment of the present invention, the auxiliary handle 290 may be connected to the lever 275 even when the lever 275 includes the insulating material, since the auxiliary handle 290 allows a user to easily move the lever 275.

The second connector 270 is electrically connected to the first connector 260. Specifically, the second connector 270 moves toward the first connector 260 such that the second connector 270 is coupled with, e.g., is connected to, the first connector 260 mounted on the driving circuit board 240. When the second connector 270 is connected to the first connector 260, the power and driving signals, which are input from the signal transmission member 280, are transferred to the first connector 260.

After the first connector 260 has been connected to the second connector 270, the lever 275 is rotated toward the first connector 260. As a result, the lever 275 is coupled with, e.g., is connected or fixed to, the first connector 260. Thus, the lever 275 effectively prevents the second connector 270 from being separated from the first connector 260.

The lever 275 is connected to the first connector 260 and is thereby fixed by the lever fixing member 267.

Referring to FIGS. 4A and 4B, the lever 275 is connected to the first housing 261 by an external force. As a result, the lever 275 rotates toward the first housing 261 about the axis defined by the rotating members 277 connected to the holes second housing 273. More specifically, the rotating members 277 rotate about the end portions of the rotating members 277 which are coupled to the second housing 273. Thus, the connection bar 278 is rotated by the external force and is thereby connected to the lever fixing member 267. In an exemplary embodiment, the lever fixing member 267 is disposed on a same plane as a plane wherein the first housing 261 makes physical contact with the connection member 278. Thus, the lever 275 effectively prevents the second housing 273 from being separated from the first housing 261, as shown in FIG. 4B.

Thus, in a connector assembly according to an exemplary embodiment of the present invention as described herein, a lever is connected to a second connector and a first connector is coupled to the second connector through the lever. In addition, the lever coupled to the first connector securely fixes the first connector and the second connector. Thus, the first connector is easily coupled to the second connector while effectively preventing the second connector from being separated from the first connector.

According to alternative exemplary embodiments of the present invention as described herein, a display apparatus includes a connector assembly having a lever connected to a second connector. Thus, a driving circuit board is easily connected to a signal transmission member, and an assembling time of the display apparatus is substantially shortened, thereby effectively increasing a production efficiency of the display apparatus.

The present invention should not be construed as being limited to the exemplary embodiments set forth herein. Rather, these exemplary embodiments are provided so that this disclosure will be thorough and complete and will fully convey the concept of the present invention to those skilled in the art.

Although the present invention has been particularly shown and described with reference to exemplary embodiments thereof, it will be understood by those of ordinary skill in the art that various changes and modifications in form and detail may be made therein without departing from the spirit or scope of the present invention as defined by the following claims.

What is claimed is:

1. A display apparatus comprising:

a display panel comprising at least one of signal lines disposed thereon;

at least one signal drivers which connected to the signal line;

at least one driving circuit board comprising at least one timing controller which is disposed thereon and supplies control signals to the signal drivers; and a female connector which is disposed on the driving circuit board and is combinable with a male connector comprising a second joining member which comprises a terminal to supply a driving signal and a lever which comprises a first rotating member rotatably connected to a first side of the male connector, a second rotating member rotatably connected to a second side of the male connector, which is disposed opposite to the first side of the male connector, and a connection bar connecting the first rotating member to the second rotating member, the female connector comprising:

a first side;

a second side opposite to the first side;

a third side adjacent to the first side;

a fourth side opposite to the third side;

a first joining member comprising a terminal disposed in the first side to receive the driving signal, the first joining member being combinable with the second joining member of the male connector; and a first locking member being combinable with the first rotating member of the male connector and comprising a protrusion protruding outward from the third side and having an interior recess portion to receive the first rotating member of the male connector.

2. The display apparatus of claim 1, further comprising:

a second locking member being combinable with the second rotating member of the male connector and comprising a protrusion protruding outward from the fourth side and having an interior recess portion to receive the second rotating member of the male connector.

3. The display apparatus of claim 1, wherein the connection bar of the male connector comprises a first guide part connected to the first rotating member, a second guide part connected to the second rotating member, and a center part connecting the first and second guide parts, and wherein the first and second guide parts are bent to connect the center part.

4. The display apparatus of claim 3, wherein the center part is spaced apart from the second side when the first rotating member is received by the interior recess portion.

5. The display apparatus of claim 4, wherein the first and second guide parts of the connection bar are spaced apart from the first joining member when the first rotating member is received by the interior recess portion, respectively.

6. The display apparatus of claim 5, wherein each of the first and second guide parts of the connection bar has a straight part parallel to the center part.

7. The display apparatus of claim 6, wherein a distance between the second side and the straight part of each of the first and second guide parts of the connection bar shorter than a distance between the second side and the center part of the connection bar when the first rotating member is received by the interior recess portion.

8. The female connector of claim 3, wherein the female connector has protrusions protruding outward from the second side corresponding to the first and second guide parts when the first rotating member is received by the interior recess portion.

9. A display apparatus comprising:

a display panel comprising at least one signal line disposed thereon;

at least one signal driver which connected to the signal line;

at least one driving circuit board comprising at least one timing controller which is disposed thereon and supplies control signals to the signal drivers; and a female connector which is disposed on the driving circuit board and is combinable with a male connector comprising a second joining member which comprises a terminal to supply a driving signal and a lever which comprises a first rotating member rotatably connected to a first side of the male connector, a second rotating member rotatably connected to a second side of the male connector, which is disposed opposite to the first side of the male connector, and a connection bar connecting the first rotating member to the second rotating member, the female connector comprising:

a first side;

a third side adjacent to the first side;

a fourth side opposite to the third side;

a second side opposite to the first side and comprising a first end part adjacent to the third side and a second end part adjacent to the fourth side;

a first joining member comprising a terminal disposed in the first side, the first joining member combinable with the second joining member of the male connector; and a first locking member combinable with the first rotating member of the male connector and comprising a protrusion protruding outward from the first end part and having an interior recess portion to fix the first rotating member of the male connector and comprising a protrusion protruding outward from the first end part and having an interior recess portion to fix the first rotating member of the male connector.

10. The display apparatus of claim 9, further comprising:

a second locking member comprising a protrusion protruding outward from the second end part and having an interior recess portion to receive the second rotating member of the male connector.

11. The display apparatus of claim 10, wherein the connection bar of the male connector comprises a first guide part connected to the first rotating member, a second guide part connected to the second rotating member, and a center part connecting the first and second guide parts, and wherein the first and second guide parts are bent to connect the center part.

12. The display apparatus of claim 11, wherein the center part is spaced apart from the second side when the first rotating member is received by the interior recess portion.

13. The display apparatus of claim 12, wherein the first and second guide parts of the connection bar are spaced apart from the first joining member when the first rotating member is received by the interior recess portion, respectively.

14. The display apparatus of claim 13, wherein each of the first and second guide parts of the connection bar has a straight part parallel to the center part.

15. The display apparatus of claim 14, wherein a distance between the second side and the straight part of each of the first and second guide parts of the connection bar shorter than a distance between the second side and the center part of the connection bar when the first rotating member is received by the interior recess portion.

16. The display apparatus of claim 11, wherein the female connector has protrusions protruding outward from the second side corresponding to the first and second guide parts when the first rotating member is received by the interior recess portion.

17. The display apparatus of claim 9, wherein the first end part, the second end part and the first joining member are spaced apart from each other.

18. A female connector combinable with a male connector comprising a second joining member which comprise a terminal to supply a driving signal and a lever which comprises a first rotating member rotatably connected to a first side of the male connector, a second rotating member rotatably connected to a second side of the male connector, which is disposed opposite to the first side of the male connector, and a connection bar connecting the first rotating member to the second rotating member, comprising:

a first side;

a second side opposite to the first side;

a third side adjacent to the first side;

a fourth sides opposite to the third side;

a first joining member comprising a terminal disposed in the first side to receive the driving signal, the first joining member being combinable with the second joining member of the male connector; and a first locking member comprising a protrusion protruding outward from the third side and having an interior recess portion to fix the first rotating member of the male connector.

19. The female connector of claim 18, further comprising:

a second locking member being combinable with the second rotating member of the male connector and comprising a protrusion protruding outward from the fourth side and having an interior recess portion to receive the second rotating member of the male connector.

20. The display apparatus of claim 2, wherein the connection bar of male connector is spaced apart from the second side when the first rotating member is received by the interior recess portion.

* * * * *